US008001986B2

(12) United States Patent
Shumate

(10) Patent No.: US 8,001,986 B2
(45) Date of Patent: Aug. 23, 2011

(54) FLEXIBLE BASE STRUCTURE FOR PORTABLE SHELTERS

(76) Inventor: Morris W. Shumate, Hamilton, GA (US)

( * ) Notice: Subject to any disclaimer, the term of this patent is extended or adjusted under 35 U.S.C. 154(b) by 0 days.

(21) Appl. No.: 12/835,567

(22) Filed: Jul. 13, 2010

(65) Prior Publication Data

US 2010/0275960 A1 Nov. 4, 2010

Related U.S. Application Data

(63) Continuation-in-part of application No. 11/687,340, filed on Mar. 16, 2007, now abandoned.

(51) Int. Cl.
*E04H 15/56* (2006.01)

(52) U.S. Cl. ..... 135/116; 135/120.3

(58) Field of Classification Search ..... 135/116, 135/119, 120.1, 120.2, 120.3, 120.4, 124, 135/134, 137, 135
See application file for complete search history.

(56) References Cited

U.S. PATENT DOCUMENTS

| | | | | |
|---|---|---|---|---|
| 960,849 | A | 6/1910 | Dilg | |
| 1,538,064 | A | 5/1925 | Skog | |
| 2,167,219 | A * | 7/1939 | Sankey | 135/133 |
| 3,037,517 | A | 6/1962 | Zent | |
| 3,059,658 | A | 10/1962 | Finlayson | |
| 3,176,698 | A | 4/1965 | Warner | |
| 3,223,098 | A | 12/1965 | Dole, Jr. | |
| 3,233,617 | A | 2/1966 | Stern | |
| 3,477,453 | A * | 11/1969 | Ulisse et al. | 135/95 |
| 3,874,397 | A | 4/1975 | Oberhaus | |
| 4,078,572 | A | 3/1978 | Moss | |
| 4,202,363 | A | 5/1980 | Watts et al. | |
| 4,236,543 | A | 12/1980 | Moss | |
| 4,305,414 | A | 12/1981 | Bareis | |
| 4,393,887 | A | 7/1983 | Orribin | |
| 4,632,138 | A | 12/1986 | Irwin | |
| 4,723,371 | A | 2/1988 | Williams | |
| 4,782,846 | A | 11/1988 | Ting | |
| 4,838,293 | A | 6/1989 | Novak | |
| 4,858,635 | A | 8/1989 | Eppenbach | |
| 4,922,942 | A | 5/1990 | Schaeffer | |
| 5,217,034 | A | 6/1993 | Yih et al. | |
| 5,404,896 | A | 4/1995 | Howe | |
| 5,615,699 | A | 4/1997 | Lee | |
| 5,660,309 | A | 8/1997 | Belanger et al. | |
| 5,669,182 | A | 9/1997 | Griffis | |

(Continued)

FOREIGN PATENT DOCUMENTS

| | | | |
|---|---|---|---|
| CH | 618083 | | 7/1980 |
| KR | 2019910005928 | U | 4/1991 |
| KR | 200250570 | Y1 | 10/2001 |
| KR | 1020060120858 | A | 11/2006 |

*Primary Examiner* — Noah Chandler Hawk
(74) *Attorney, Agent, or Firm* — Robert A. Blaha; Smith Risley Tempel Santos LLC

(57) ABSTRACT

An example method for providing a flexible base structure for a portable shelter includes the steps of forming a continuous loop of a flexible material and attaching a plurality of rib intersections such as grommets at respective locations along the flexible loop. An alternative method for constructing a flexible base structure for a floorless portable shelter includes forming a continuous loop of a flexible material and arranging a plurality of openings at respective locations along the continuous loop. An embodiment of a base structure for supporting the ribs of a portable shelter includes a flexible loop and a plurality of rib intersections arranged along the flexible loop. Each of the plurality of rib intersections forms an opening for receiving a respective end of a rib that supports the portable shelter.

12 Claims, 4 Drawing Sheets

U.S. PATENT DOCUMENTS

| | | | | |
|---|---|---|---|---|
| 5,699,820 | A | 12/1997 | Evans et al. | |
| 6,748,962 | B2 | 6/2004 | Miller | |
| 6,892,742 | B2 * | 5/2005 | Wang | 135/125 |
| 7,025,073 | B2 | 4/2006 | Holub | |
| 2002/0020439 | A1 | 2/2002 | Tate | |
| 2002/0139408 | A1 | 10/2002 | Mitzner | |
| 2003/0000563 | A1 | 1/2003 | Kuperman | |
| 2006/0185707 | A1 | 8/2006 | Viglione | |
| 2011/0108078 | A1 * | 5/2011 | Roman et al. | 135/121 |

* cited by examiner

FLEXIBLE BASE STRUCTURE FOR PORTABLE SHELTERS

CROSS REFERENCE TO RELATED APPLICATION

This application is a continuation-in-part of copending U.S. patent application Ser. No. 11/687,340, filed Mar. 16, 2007, entitled "Flexible Base Structure For Portable Shelters," the priority of which is hereby claimed and the specification thereof incorporated herein in its entirety by this reference.

BACKGROUND

Outdoor portable shelters such as tents have been used to provide temporary shelter and protection from the sun, wind, precipitation, harsh temperatures, condensation, biting insects, and other outdoor elements for workers, equipment, and outdoor enthusiasts for many years. Aside from protecting an interior volume from the elements, modern day shelters should be quick to set-up and portable. To be portable, the temporary shelter should be lightweight so it is easily carried to a proposed site as well as easy to assemble and disassemble.

Most conventional tents are configured with a floor that is made of a heavier material than that used for the portions of the tent that will not be in contact with the ground. The weight of the heavier material used to construct the floor of these tents makes up a significant portion of the overall weight of the tent. The floor is often configured with loops at fixed locations along the perimeter of the tent for receiving a stake that sets or fixes the floor of the tent to the ground. These floors are often configured with additional hardware and or loops for locating and receiving an end of a flexible support rib. Once all the support ribs are flexed and set at their designated receiving ends in or near the perimeter of the floor, the upper panels of the tent can be supported from the ribs. Some conventional tents use sleeves formed or otherwise attached to the outer surface of the upper panels of material to suspend the tent. Other conventional tents use hooks connected to tabs or other extensions that are sewn to the upper panels of the tent to suspend the tent under the support ribs. Many of these conventional tents use a rain fly to further shelter the tent.

A rain fly protects the tent from harmful ultraviolet radiation from the sun. In addition to protecting the tent from the sun, a rain fly provides an additional barrier in the rain and snow, can help keep sparks from a fire or wood stove away from the exterior surface of the tent and when set up correctly can provide an insulating layer when it is cold. Conventional rain flies are made from a relatively lightweight fabric made from man-made fibers (e.g., nylon, polyester) with canvas ties or other heavier fabrics used together with hook and loop fasteners for fixing the rain fly to support ribs. The fabric is often treated or coated with various waterproofing and fire resistant agents. When appropriate, a hole for a stove jack or vent will be formed with canvas or reinforced webbing.

Some outdoor enthusiasts prefer to travel with as little gear as possible. For example, some hikers and climbers when faced with transporting food, water, fuel, a sleeping bag and roll, a portable shelter and perhaps additional items including a community shelter for meeting, cooking, or other functions will elect to carry a relatively lightweight rain fly with the necessary support ribs rather than a conventional tent with a floor.

However, absent the orientation and resistance provided by a conventional tent with a floor, a lightweight rain fly or other lightweight portable shelter without a floor can be difficult if not impossible to set-up by oneself. Setup of a lightweight cover, such as a rain fly, is problematic for at least the reason that it is difficult to align and flex the various ribs into their desired orientation absent the footprint provided by the floor of the corresponding tent.

Accordingly, it would be desirable to develop an apparatus and various methods that overcome these shortcomings.

SUMMARY

A flexible and scalable base structure for floorless portable shelters and methods for constructing and using the same are invented and disclosed.

One embodiment of a base structure for floorless portable shelters includes a flexible loop and a plurality of rib intersections arranged along the flexible loop, each of the plurality of rib intersections forming an opening for receiving a respective end of a rib. The flexible loop is arranged in a length that enables each of the rib intersections to be positioned to receive a corresponding end of a rib or other flexible member that supports the material of a rain fly or other cover in a desired configuration.

An alternative embodiment of a base structure for supporting the ribs of a portable shelter includes a continuous loop formed by a fixed junction that connects a first end and a second end of a single length of webbing material to each other, the continuous loop being devoid of an intersecting member in a plane defined by the continuous loop, the continuous loop forming a perimeter of a floorless portable shelter and a plurality of grommets separated from each other and arranged within the perimeter defined by the continuous loop. Each of the grommets includes an opening for receiving a respective end of a rib. In this alternative embodiment, the fixed junction provides an indicator identifying the location of a feature of the portable shelter and the grommets are located at positions other than a location of the fixed junction such that the fixed junction is substantially equidistant from the closest two grommets. Moreover, each of the grommets is a member of a set of two grommets configured to receive a first end of a rib and a second end of the rib.

Another alternative embodiment of a base structure for a floorless portable shelter includes a flexible loop having an adjustable length and a plurality of rib receiving members arranged along the length of the flexible loop. Each of the plurality of rib receiving members can be moved along the length of the flexible loop. In this alternative embodiment, an even number of the rib receiving members can be suitably positioned to support any number of floorless portable shelters by setting the length of the perimeter formed by the flexible loop and moving each of the rib receiving members to an appropriate location along the flexible loop.

Another embodiment of a base structure for floorless portable shelters includes a flexible loop and a plurality of rib receiving members arranged at fixed positions relative to each other along the length of the flexible loop.

Still another embodiment of a base structure for supporting the ribs of a portable shelter includes a continuous loop formed by a fixed junction that directly connects a first end to a second end of a single length of webbing material, the continuous loop being devoid of an intersecting member in a plane formed by the continuous loop and a plurality of grommets arranged within a perimeter defined by the continuous loop. The grommets are located at respective positions along the webbing material for receiving a respective end of a rib and arranged such that the fixed junction is substantially equidistant from the closest two grommets. A grommet is not located within the fixed junction.

An embodiment of a method for providing a flexible base structure for a portable shelter includes the steps of forming a continuous loop of a flexible material and attaching a plurality of rib intersections at respective locations along the flexible loop.

An alternative embodiment of a method for constructing a flexible base structure for a floorless portable shelter includes the steps of forming a continuous loop of a flexible material and arranging a plurality of openings at respective locations along the continuous loop.

Other devices, methods, features and advantages will be or will become apparent to one skilled in the art upon examination of the following figures and detailed description. All such additional devices, methods, features and advantages are defined and protected by the accompanying claims.

BRIEF DESCRIPTION OF THE DRAWINGS

The flexible base structure for portable shelters, as defined in the claims, can be better understood with reference to the following drawings. The components within the drawings are not necessarily to scale relative to each other; emphasis instead is placed upon clearly illustrating the elements, features and principles involved in supporting the ribs or flexible poles of a fly, rain cover, or floorless tent with the flexible base structure.

DETAILED DESCRIPTION

Flexible and scalable base structures for floorless portable shelters and methods for constructing and using the same are invented and disclosed. The base structures for floorless portable shelters are lightweight and enable a user to assemble easily a floorless portable shelter without the assistance of others.

The base structures include a continuous or primary loop that can be formed from webbing, rope, cable or wire or other lightweight materials that will not stretch or shrink significantly over a range of temperature, humidity and in the presence of contaminants. In some configurations, the continuous loop of webbing material forms a fixed perimeter. In these configurations, a fixed junction connects a first end to a second end of a single length of webbing material. The fixed junction is located at a reference point that identifies a corresponding feature of the portable shelter that is assembled or constructed above the base structure. The fixed junction is located at a position along the continuous loop that is substantially equidistant from the closest two grommets. Preferably, the fixed junction is located near the center of a door or opening in the portable shelter.

In a first alternative embodiment, a first end of webbing, rope or other materials is connected to a strap or buckle that can receive the opposing end of the webbing, rope or other material to enable a user to form a primary loop with an adjustable length. In a second alternative embodiment, one or more sections or segments of the primary loop are arranged with respective friction lock collars that are fixed to respective ends of a wire or cable. The friction lock collars provide a mechanism for adjusting the perimeter of the flexible base structure.

Rib intersections or grommets are arranged at desired locations along the continuous loop. The grommets receive respective rib ends (i.e., the ends of support members) of the portable shelter to be constructed and supported using the base structure. Some of the illustrated embodiments show the grommets directly embedded within the continuous loop (i.e., in the webbing), while other embodiments include a secondary loop with a respective grommet for receiving and locating the rib ends. Embodiments that include a secondary loop can be arranged such that the secondary loop is at a fixed location along the length of the primary loop. Alternatively, one or more of the secondary loops can be configured to be moved along the length of the primary loop. Embodiments that use a secondary loop of sufficient size that surrounds the continuous loop can be twisted to align an opening for receiving and holding a respective rib end. These arrangements can be constructed without grommets. A rib intersection can also be formed by a member with a channel for receiving a portion of the continuous loop and a tab with a suitably sized hole for receiving a rib end.

Figure 1:
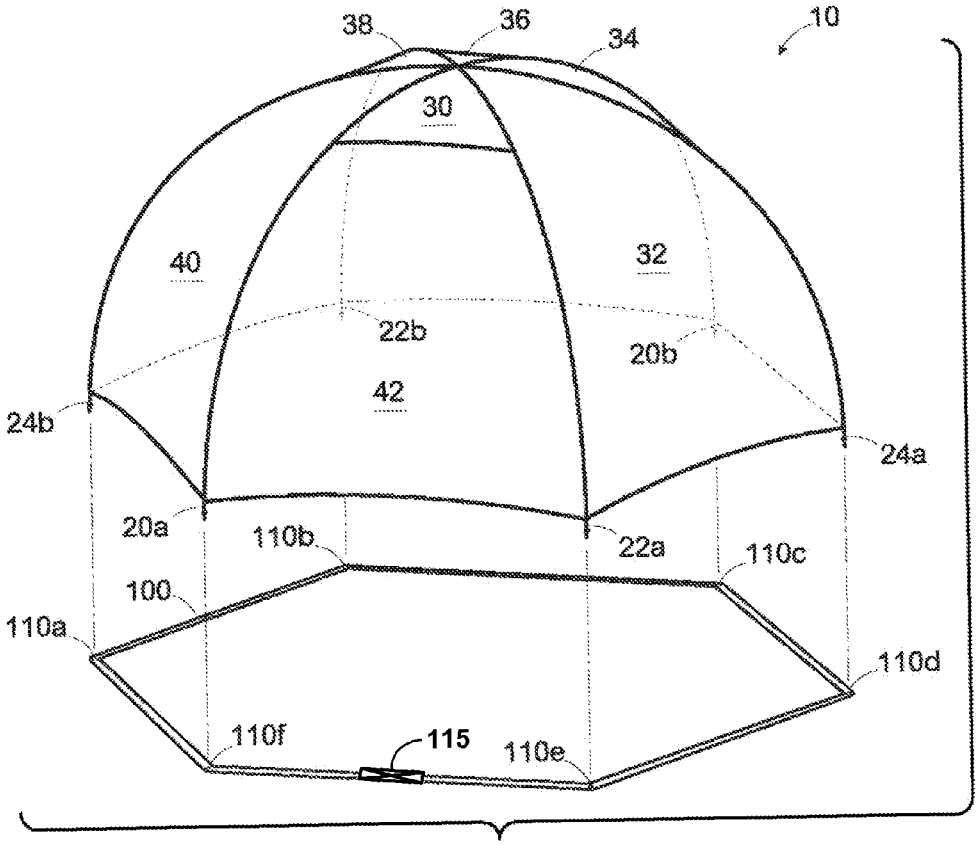
FIGS. 1 and 2 are schematic diagrams illustrating an embodiment of a base structure in relationship with an assembled portable shelter.

Having generally described the base structures for floorless portable shelters, various additional embodiments will be described in detail with respect to FIGS. 1-13. FIG. 1 is an exploded front view illustrating a portable shelter 10 above a base structure 100. Portable shelter 10 is supported by three ribs. A first rib end 20*a* extends beyond the lower edge of panel 40 and the lower edge of panel 42 at the intersection of the panels. Rib 20 forms an arch that extends to an opposing side of the portable shelter 10 where rib end 20*b* extends below the lower edge of panel 34 and panel 36 at the intersection of the panels. A second rib end 22*a* extends beyond the lower edge of panel 42 and the lower edge of panel 32 at the intersection of the panels. Rib 22 forms an arch that extends to an opposing side of the portable shelter 10 where rib end 22*b* extends below the lower edge of panel 36 and panel 38 at the intersection of the panels. A third rib end 24*a* extends beyond the lower edge of panel 32 and the lower edge of panel 34 at the intersection of the panels. Rib 24 forms an arch that extends to an opposing side of the portable shelter 10 where rib end 24*b* extends below the lower edge of panel 38 and the lower edge of panel 40 at the intersection of the panels.

Panel 30, panel 32, panel 34, panel 36, panel 38, panel 40 and panel 42 lie above rib 20, rib 22, and rib 24. Each of the panels is made from a lightweight fabric made from man-made fibers (e.g., nylon, polyester). The panels may be treated with various sprays, solutions or other agents to make the portable shelter 10 resistant to fire, wind and water penetration and damage from ultraviolet radiation. Each of the panels is configured with hooks, ties or hook-and-loop fasteners to keep the panels correctly positioned above and in close contact with the respective ribs.

Unlike most conventional tents, portable shelter 10 is open to the ground or surface that will support rib end 20*a*, rib end 20*b*, rib end 22*a*, rib end 22*b*, rib end 24*a* and rib end 24*b*.

Panel 30 is located at the upper edge of panel 42 and between panel 40 and panel 32. The edges of panel 42 are connected to panel 30 and one or both of panel 40 and 32 via a zipper so that panel 42 can be removed or inserted in place to enable access and egress to the interior of the portable shelter 10.

As illustrated in FIG. 1, base structure 100 can be placed along a supporting surface and arranged such that rib intersections (e.g., grommets) 110 align with a corresponding rib end from the portable shelter 10. Rib end 20*a* is received by rib intersection 110*f*. Rib end 22*a* is received by rib intersection 110*e*. Rib intersection 24*a* is received by rib intersection 110*d*. Rib end 20*b* is received by rib intersection 110*c*. Rib end 22*b* is received by rib intersection 110*b*. Rib intersection 24*b* is received by rib intersection 110*a*.

In an example embodiment, the base structure 100 is constructed of a continuous loop of webbing material. The continuous loop of webbing material forms the perimeter of the portable shelter 10. The portable shelter 10 is a floorless shelter that permits the portable shelter 10 to be constructed on uneven or rocky ground, above a portable latrine, etc. The base structure 100 of the portable shelter 10 is entirely devoid of intersecting members in a plane defined by the continuous loop. A first end of a single length of webbing material is connected to a second end of the webbing material at a fixed junction 115. The fixed junction 115 provides an indication of a feature of the portable shelter 10 to be constructed upon the base structure 100. The fixed junction 115 is substantially equidistant from the closest two grommets or rib intersections located along the continuous loop. In the illustrated embodiment, the fixed junction 115 is sewn and provides an indication of the center of an opening or door in the portable shelter 10. In some embodiments, the fixed junction 115 is formed by overlapping a portion of one of the first end or the second end of the single length of webbing material over the remaining end before sewing and/or gluing or applying an adhesive layer in contact with the overlapping portion of the webbing material to complete the fixed junction 115.

Rib intersections 110 or grommets are located within a perimeter defined by the continuous loop. In addition, rib intersections 110 or grommets are not located in or near the fixed junction 115. Moreover, each of the rib intersections 110 or grommets is a member of a set of two grommets configured to receive a first end and a second end of a rib.

Figure 2:
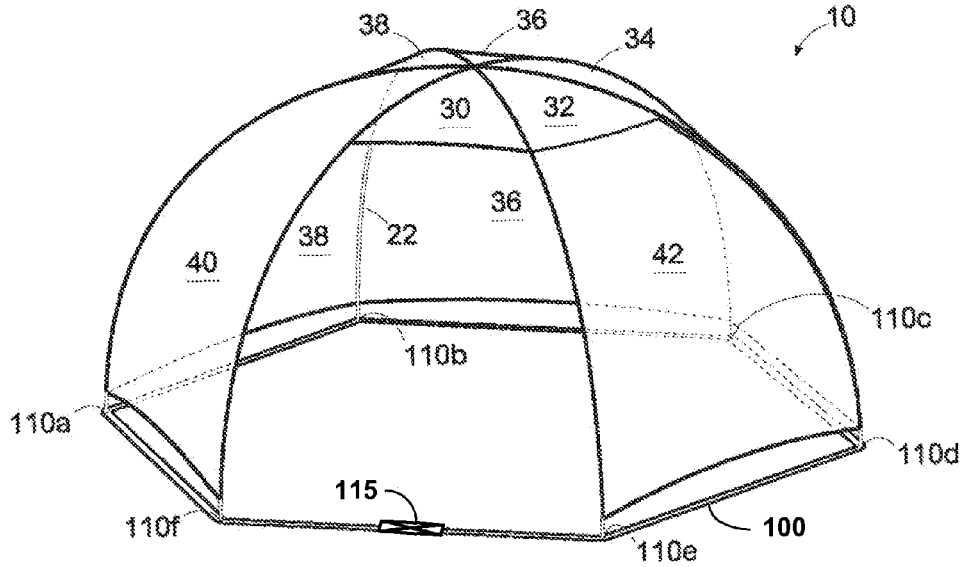

FIG. 2 shows portable shelter 10 in position over base structure 100. Panel 42 is folded over panel 32 to reveal the interior volume of portable shelter 10. In the field, an assembler constructs the portable shelter 10 by arranging base structure 100 along the ground. The fixed junction 115 provides a reference for the assembler in that it defines the location of a feature of the portable shelter 10 that is supported by the base structure 100. In the illustrated embodiments, the fixed junction 115 marks the center of a door or opening in the portable shelter 10. Next, rib 20, rib 22 and rib 24 are positioned in the base structure 100 by engaging a first rib end such as rib end 20*a* in rib intersection 110*f* and flexing rib 20 until rib end 20*b* can be inserted into rib intersection 110*c*. The flexed rib 20 is then placed on the ground in its flexed condition. Next, another rib end, such as rib end 22*a* is inserted in rib intersection 110*e*. Rib 22 is flexed until the opposing rib end 22*b* can be inserted in rib intersection 110*b*. The flexed rib 22 is placed on the ground in its flexed condition. Thereafter, the remaining rib, rib 24 is added by placing rib end 24*a* into rib intersection 110*d* and flexing rib 24 until rib end 24*b* can be inserted in rib intersection 110*a*. After the ribs have been flexed, they can be lifted and arranged close to one another above the ground in proximity with the center of the area encompassed by the base structure 100 where they can be tied, clamped or otherwise connected to each other such that they remain standing above the ground.

Upon easily accomplishing the heretofore difficult task of arranging the support ribs for the portable shelter 10, the assembler arranges the various panel intersections over the ribs and connects the panel intersections to corresponding ribs with the provided hooks, ties, or hook and loop fasteners so that the base edge of each of the respective panels is proximally located to the base structure 100.

Figure 3:
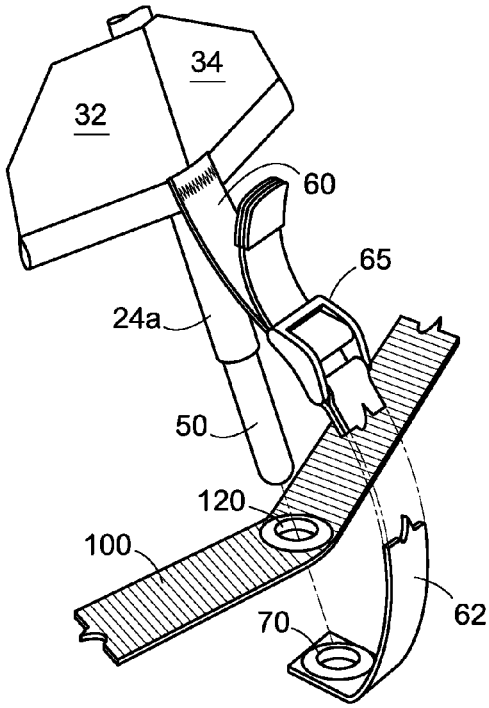
FIGS. 3 and 4 are schematic diagrams detailing the integration of a supporting rib and cover of a portable shelter at a select location along the base structure of FIGS. 1 and 2.
Figure 4:
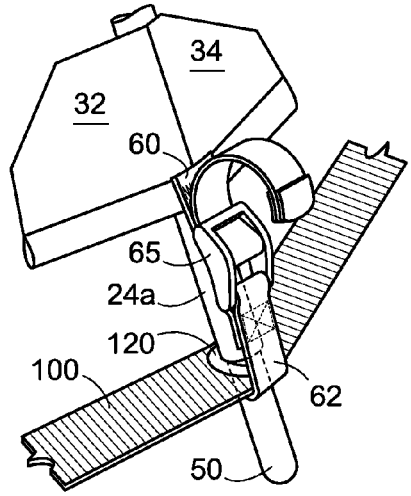

FIGS. 3 and 4 are schematic diagrams detailing the integration of a supporting rib and cover of a portable shelter at a select location along the base structure 100 of FIGS. 1 and 2. FIG. 3 shows rib end 24*a* separated from a first grommet 120 integrated with base structure 100 and a second grommet 70 integrated with an extension strap 62. Rib end 24*a* includes probe 50, which fits within the corresponding openings formed by grommet 120 and grommet 70. Once probe 50 engages grommet 120 and grommet 70, extension strap 62 and cover strap 60 can be adjusted via buckle 65 or some other tensioning apparatus to pull panel 32 and panel 34 into position near base structure 100.

Figure 5:
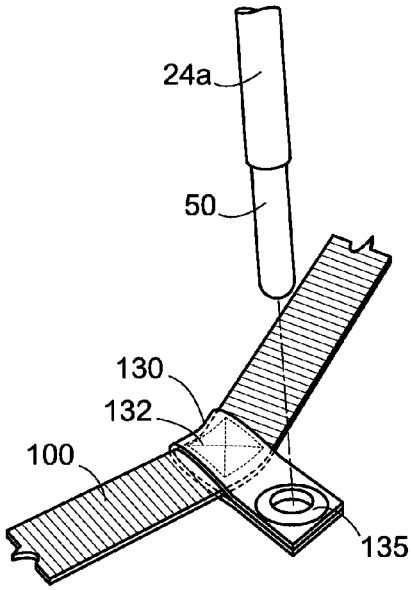
FIG. 5 is a schematic diagram illustrating the integration of a supporting rib of a portable shelter with an alternative base structure.

FIG. 5 is a schematic diagram illustrating the integration of a supporting rib of a portable shelter with an alternative base structure. As illustrated in FIG. 5, a secondary loop 130 with a corresponding grommet 135 can be located at an appropriate position along base structure 100 for receiving probe 50 of rib end 24*a*. In the illustrated embodiment, secondary loop 130 is fixed to base structure 100 by sewing the secondary loop 130 to the webbing as indicated by stitch pattern 132.

Figure 6:
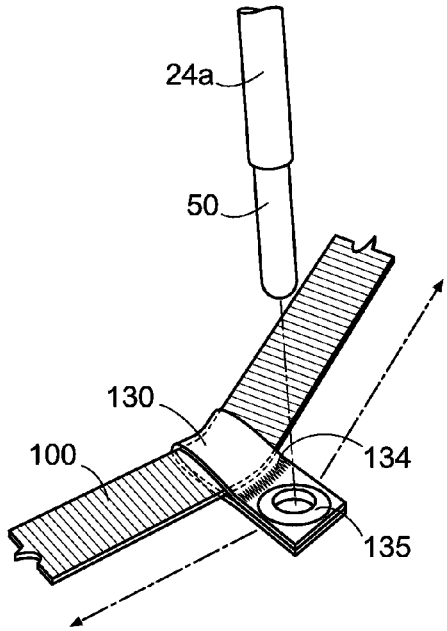
FIG. 6 is a schematic diagram illustrating the integration of a supporting rib of a portable shelter with a third alternative base structure.

FIG. 6 is a schematic diagram illustrating the integration of a supporting rib of a portable shelter with a third alternative base structure. As shown in FIG. 6, a secondary loop 130 with a corresponding grommet 135 can be sewn together via stitches 134 beyond the webbing of base structure 100, such that secondary loop 130 can be positioned as may be desired along the length of base structure 100.

In still another embodiment (not shown), a secondary loop 130 can be formed absent a grommet. The secondary loop 130 can be fixed to the base structure 100 as indicated in FIG. 5 or configured as shown in FIG. 6 such that the secondary loop 130 can be manipulated along base structure 100. As long as the secondary loop can be twisted to receive probe 50, no grommet is required. This alternative configuration would benefit from a slot or groove in probe 50 or near the intersection of probe 50 and rib end 24*a* to engage the secondary loop.

FIGS. 7-11 are schematic diagrams illustrating various embodiments of a base structure for portable shelters 10 that integrate with three support ribs. The base structures illustrated in FIGS. 7-11 are shown in a taught arrangement as if they were positioned by flexed ribs.

Figure 7:
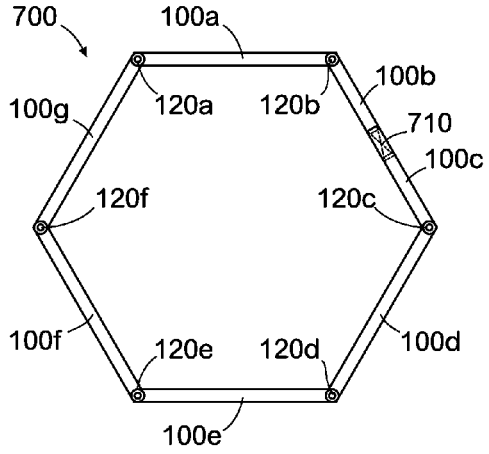
FIGS. 7-11 are schematic diagrams illustrating various alternative embodiments of a base structure for portable shelters that integrate with three support ribs.

FIG. 7 includes base structure 700 made of a length of webbing sewn together at junction 710 to form a primary or continuous loop. Rib intersections include grommets 120 strategically separated from their nearest neighbor grommets along the length of base structure 700. An uppermost segment 100*a* is defined by grommet 120*a* and grommet 120*b*. Moving in a clockwise rotation around base structure 700, segment 100*b* is defined by grommet 120*b* and junction 710. Segment 100*c* is defined by junction 710 and grommet 120*c*. Segment 100*d* is defined by grommet 120*c* and grommet 120*d*. Segment 100*e* is defined by grommet 120*d* and grommet 120*e*. Segment 100*f* is defined by grommet 120*e* and grommet 120*f*. Lastly, segment 100*g* is defined by grommet

120*f* and grommet 120*a*. As described above in association with FIGS. 1 and 2, grommets 120 are separated from their nearest neighbor grommets such that each of the grommets can receive a respective rib end of a correspondingly arranged portable shelter.

Figure 8:
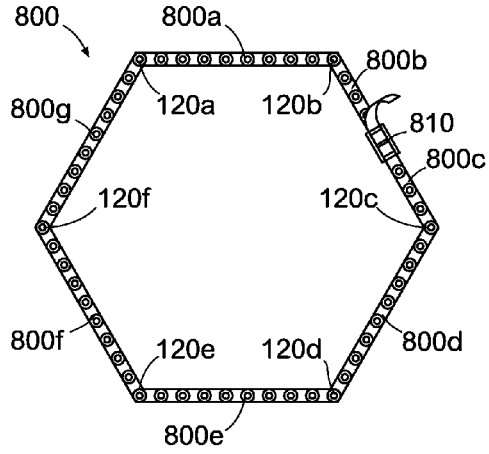

FIG. 8 includes base structure 800 made of a length of webbing coupled together at buckle 810 to form a primary or continuous loop. The addition of buckle 810 permits easy adjustment of the length of base structure 800. Rib intersections include grommets 120 strategically separated from their nearest neighbor grommets along the length of base structure 800. Additional grommets are integrated in the webbing to enable a user to select the most appropriate grommet for receiving a probe to form a desired portable shelter. In this regard, grommets may be color coded, labeled or otherwise marked to indicate a set of grommets that can be used to support the ribs of a portable shelter. An uppermost segment 800*a* is defined by grommet 120*a* and grommet 120*b* with additional grommets disposed between the two. Moving in a clockwise rotation around base structure 800, segment 800*b* is defined by grommet 120*b* and buckle 810. Segment 800*c* is defined by buckle 810 and grommet 120*c*. Segment 800*d* is defined by grommet 120*c* and grommet 120*d*. Segment 800*e* is defined by grommet 120*d* and grommet 120*e*. Segment 800*f* is defined by grommet 120*e* and grommet 120*f*. Lastly, segment 800*g* is defined by grommet 120*f* and grommet 120*a*. As with segment 800*a*, each of the remaining segments includes additional grommets between the end grommets that define the segment. As described above in association with FIGS. 1 and 2, grommets 120 are configured to receive a respective rib end of a correspondingly arranged portable shelter. However, in the adjustable embodiment illustrated in FIG. 8 only a select number of the grommets available will be used to support a rib end.

Figure 9:
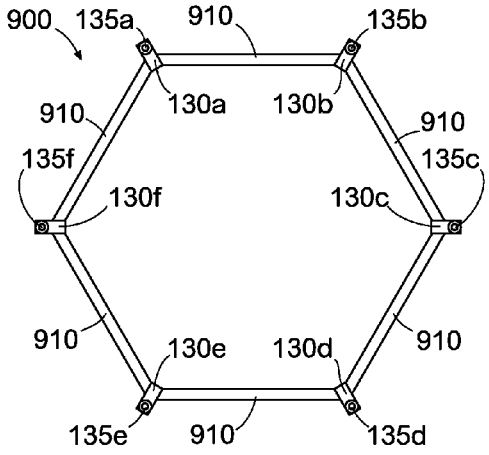

FIG. 9 includes base structure 900 made of a length of webbing 910 that forms a primary or continuous loop. Rib intersections include grommets 135 in secondary loops 130 separated from their nearest neighbor grommets along the length of base structure 900. As described above, secondary loops 130 can be arranged to slide along the length of webbing 910. An uppermost portion is defined by secondary loop 130*a* and grommet 135*a* at a left most location and secondary loop 130*b* and grommet 135*b* at a right most location. Moving in a clockwise rotation around base structure 900, an upper right side portion is defined by secondary loop 130*b* and grommet 135*b* at an upper location and secondary loop 130*c* and grommet 135*c* at a lower location. A lower right side portion is defined by secondary loop 130*c* and grommet 135*c* at an upper location and secondary loop 130*d* and grommet 135*d* at a lower location. A lowermost portion is defined by secondary loop 130*d* and grommet 135*d* at a rightmost location and secondary loop 130*e* and grommet 135*e* at a leftmost location. A lower left side portion is defined at a lower location by secondary loop 130*e* and grommet 135*e* at a rightmost location and secondary loop 130*f* and grommet 135*f* at a leftmost location. A last portion is defined by secondary loop 130*f* and grommet 135*f* at a leftmost location and secondary loop 130*a* and grommet 135*a* at a rightmost location. As described above in association with FIGS. 1 and 2, grommets 135 are separated from their nearest neighbor grommets such that each of the grommets can receive a respective rib end of a correspondingly arranged portable shelter.

Figure 10:
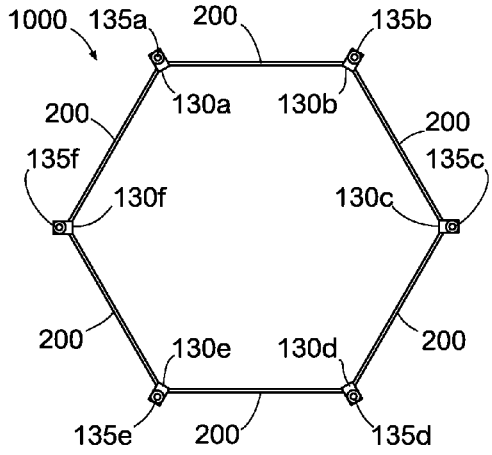

FIG. 10 includes base structure 1000 made of a length of cord 200. Cord 200 may be tied to itself, crimped or otherwise coupled via a mechanical coupler. Rope, wire, cable, etc. can be used as substitutes for cord 200 as long as the material used is arranged in a primary loop. Rib intersections include grommets 135 in secondary loops 130 strategically separated from their nearest neighbor grommets along the length of base structure 1000. As described above, secondary loops 130 can be arranged to slide along the length of cord 200. An uppermost portion is defined by secondary loop 130*a* and grommet 135*a* at a left most location and secondary loop 130*b* and grommet 135*b* at a right most location. Moving in a clockwise rotation around base structure 1000, an upper right side portion is defined by secondary loop 130*b* and grommet 135*b* at an upper location and secondary loop 130*c* and grommet 135*c* at a lower location. A lower right side portion is defined by secondary loop 130*c* and grommet 135*c* at an upper location and secondary loop 130*d* and grommet 135*d* at a lower location. A lowermost portion is defined by secondary loop 130*d* and grommet 135*d* at a rightmost location and secondary loop 130*e* and grommet 135*e* at a leftmost location. A lower left side portion is defined at a lower location by secondary loop 130*e* and grommet 135*e* at a rightmost location and secondary loop 130*f* and grommet 135*f* at a leftmost location. A last portion is defined by secondary loop 130*f* and grommet 135*f* at a leftmost location and secondary loop 130*a* and grommet 135*a* at a rightmost location. As described above in association with FIGS. 1 and 2, grommets 135 are separated from their nearest neighbor grommets such that each of the grommets can receive a respective rib end of a correspondingly arranged portable shelter.

Figure 11:
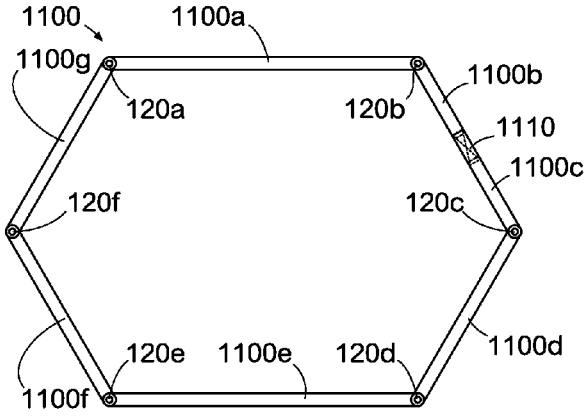

FIG. 11 includes base structure 1100 made of a length of webbing sewn together at junction 1110 to form a primary loop. Rib intersections include grommets 120 strategically separated from their nearest neighbor grommets along the length of base structure 1100. An uppermost segment 1100*a* is defined by grommet 120*a* and grommet 120*b*. Moving in a clockwise rotation around base structure 1100, segment 1100*b* is defined by grommet 120*b* and junction 1110. Segment 1100*c* is defined by junction 1110 and grommet 120*c*. Segment 1100*d* is defined by grommet 120*c* and grommet 120*d*. Segment 1100*e* is defined by grommet 120*d* and grommet 120*e*. Segment 1100*f* is defined by grommet 120*e* and grommet 120*f*. Lastly, segment 1100*g* is defined by grommet 120*f* and grommet 120*a*. As described above in association with FIGS. 1 and 2, grommets 120 are separated from their nearest neighbor grommets such that each of the grommets can receive a respective rib end of a correspondingly arranged portable shelter.

Base structure 1100 differs from base structure 700 (FIG. 7) in that the uppermost and lowermost segments have a length that is longer than the other segments. Other arrangements are possible as may be desired to support variously configured portable shelters.

Figure 12:
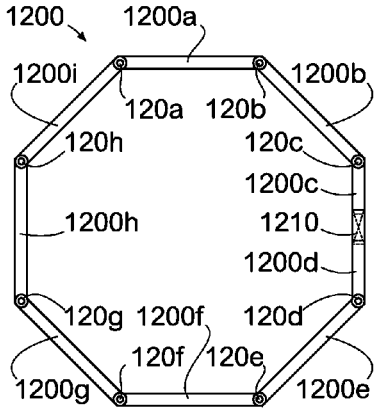
FIG. 12 is a schematic diagram illustrating a base structure for portable shelters that integrates with four support ribs.

FIG. 12 is a schematic diagram illustrating a base structure for portable shelters that integrates with four support ribs. FIG. 12 includes base structure 1200 made of a length of webbing sewn together at junction 1210 to form a primary or continuous loop. Rib intersections include grommets 120 strategically separated from their nearest neighbor grommets along the length of base structure 1200. An uppermost segment 1200*a* is defined by grommet 120*a* and grommet 120*b*. Moving in a clockwise rotation around base structure 1200, segment 1200*b* is defined by grommet 120*b* and grommet 120*c*. Segment 1200*c* is defined by junction 1210 and grommet 120*c*. Segment 1200*d* is defined by junction 120 and grommet 120*d*. Segment 1200*e* is defined by grommet 120*d* and grommet 120*e*. Segment 1200*f* is defined by grommet 120*e* and grommet 120*f*. Segment 1200*g* is defined by grommet 120*f* and grommet 120*g*. Segment 1200*h* is defined by grommet 120*g* and grommet 120*h*. Lastly, segment 1200*i* is defined by grommet 120*h* and grommet 120*a*. As described above in association with FIGS. 1 and 2, grommets 120 are separated from their nearest neighbor grommets such that each of the grommets can receive a respective rib end of a correspondingly arranged portable shelter. Those skilled in the art will appreciate that various base structure configurations are possible. For example, base structure configurations that include more or less rib intersections.

Figure 13:
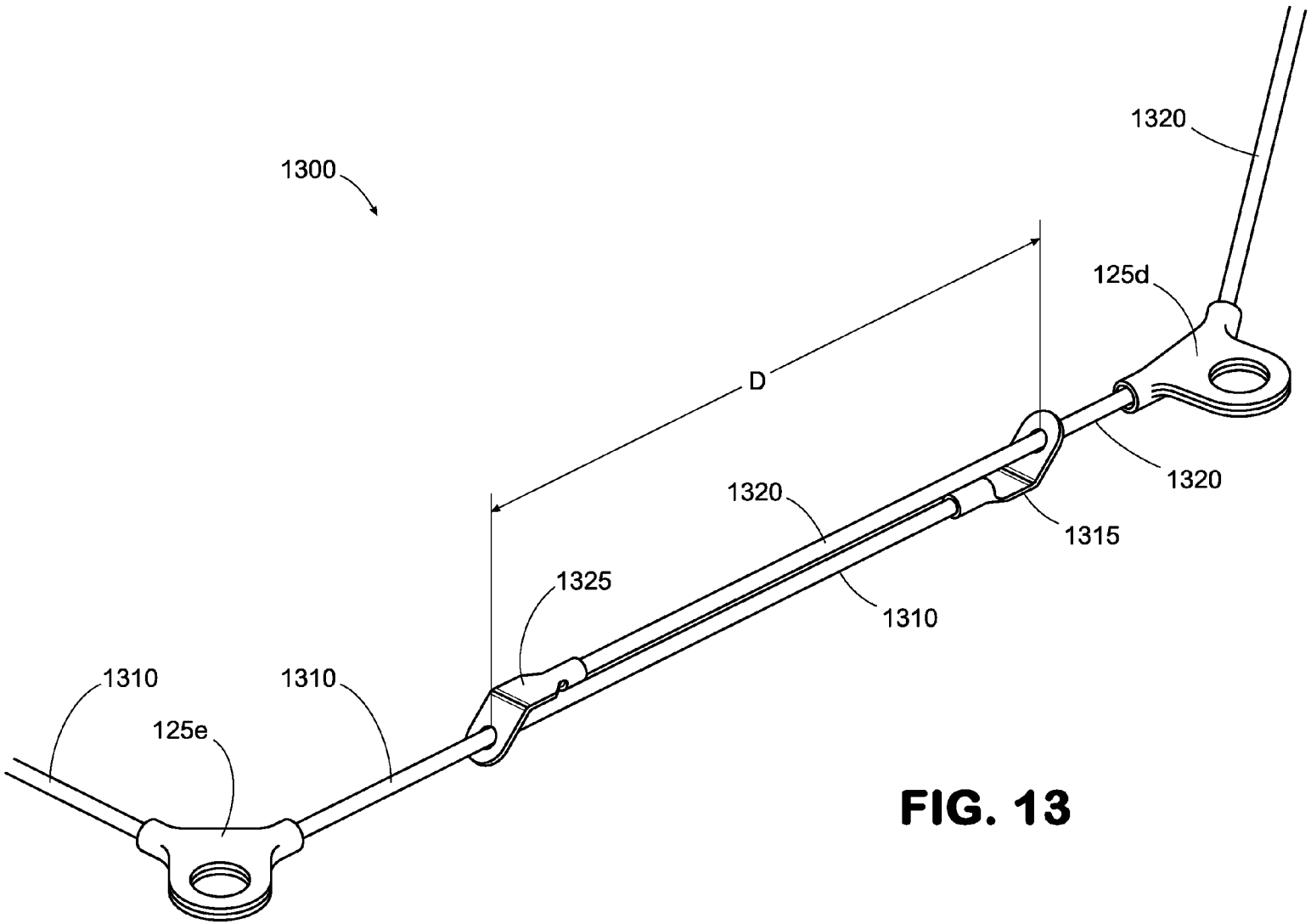
FIG. 13 is a schematic diagram illustrating a portion of a base structure having an adjustable length.

FIG. 13 is a schematic diagram illustrating an adjustable length segment 1300 or portion of a base structure. Member 125*d* includes a channel that encompasses a portion of a cable or wire used to form the primary loop. Member 125*d* further includes a tab with a hole suitably configured for receiving a rib end. Member 125*e* includes similar features (i.e., the channel and tab) for receiving a different rib end. A first cable portion 1310, which traverses the channel of member 125*e* is coupled to friction lock collar 1315. A second cable portion 1320, which traverses the channel of member 125*d* is coupled to friction lock collar 1325. Length "D," or the distance along the primary loop defined by the location of the respective friction lock collars is adjusted by rotating the coupled portion of the friction lock collar towards the closer of the two members to disengage the collar from the cable. Once disengaged, the friction lock collar can be adjusted along the length of the opposing cable. Once the friction lock collar is positioned where desired, the friction lock collar can be re-engaged along the opposing cable.

A method for constructing a flexible base structure 100 for a floorless portable shelter 10 includes the steps of forming a continuous loop of a flexible material and arranging openings at respective locations along the continuous loop.

A method for providing a flexible base structure for a portable shelter includes the steps of forming a continuous loop of a flexible material and attaching rib intersections at respective locations along the flexible loop. Thereafter, the continuous loop can be placed along a surface to form a perimeter that closely approximates a base edge of a desired portable shelter.

Although disclosed embodiments use arrangements configured to engage flexible portable shelters that use three and four ribs to support a fabric cover, it should be understood that alternative arrangements are possible. For example, a flexible base structure can be configured to engage as few as two ribs and up to as many ribs as may be desired.

The foregoing description has been presented for purposes of illustration and description. It is not intended to be exhaustive or to limit the scope of the claims to the precise forms disclosed. Modifications or variations are possible in light of the above teachings. The embodiments discussed, however, were chosen and described to enable one of ordinary skill to utilize various embodiments of the present flexible base structures and methods for constructing and using the same. All such modifications and variations are within the scope of the appended claims when interpreted in accordance with the breadth to which they are fairly and legally entitled.

What is claimed is:

1. A base structure for supporting the ribs of a portable shelter, comprising:

a continuous loop formed by a fixed junction that connects a first end and a second end of a single length of webbing material to each other, the continuous loop being devoid of an intersecting member in a plane defined by the continuous loop, the continuous loop forming a perimeter of a floorless shelter;

a plurality of grommets arranged within a perimeter defined by the continuous loop, each of the plurality of grommets including an opening for receiving a respective end of a rib, the plurality of grommets located at positions other than a location of the fixed junction such that the fixed junction is substantially equidistant from the closest two grommets, wherein each of the grommets is a member of a set of two grommets configured to receive a first end of a rib and a second end of the rib.

2. The base structure of claim 1, wherein the location of the fixed junction provides an indication of a feature of the portable shelter to be constructed upon the base structure.

3. The base structure of claim 1, wherein the location of the fixed junction is approximate to the center of an opening in the portable shelter to be constructed upon the base structure.

4. The base structure of claim 1, wherein the fixed junction is sewn.

5. The base structure of claim 1, wherein the fixed junction is formed by overlapping a portion of one of the first end or the second end over the remaining end.

6. The base structure of claim 5, wherein the fixed junction includes an adhesive layer in contact with the portion of one of the first end or the second end over the remaining end of the single length of webbing material.

7. A base structure for supporting the ribs of a portable shelter, comprising:

a continuous loop formed by a fixed junction that directly connects a first end to a second end of a single length of webbing material, the continuous loop being devoid of an intersecting member in a plane formed by the continuous loop; and a plurality of grommets arranged within a perimeter defined by the continuous loop, each of the plurality of grommets including an opening for receiving a respective end of a rib, the plurality of grommets located at respective positions other than the fixed junction such that the fixed junction is substantially equidistant from the closest two grommets.

8. The base structure of claim 7, wherein the fixed junction is sewn.

9. The base structure of claim 7, wherein the location of the fixed junction provides an indication of a feature of the portable shelter to be constructed upon the base structure.

10. The base structure of claim 7, wherein the location of the fixed junction is approximate to the center of an opening in the portable shelter to be constructed upon the base structure.

11. The base structure of claim 7, wherein the fixed junction is formed by overlapping a portion of one of the first end or the second end over the remaining end.

12. The base structure of claim 11, wherein the fixed junction includes an adhesive layer in contact with the portion of one of the first end or the second end over the remaining end of the single length of webbing material.

* * * * *